United States Patent [19]

Knight et al.

[11] Patent Number: 4,711,309

[45] Date of Patent: Dec. 8, 1987

[54] DRILLING APPARATUS

[75] Inventors: Robert G. Knight, Stoke Golding; Samir R. Klat, Burwood Park; Kenneth Unwin, Moira, all of England

[73] Assignee: Nytol Enterprises Limited, Channel Islands

[21] Appl. No.: 879,525

[22] Filed: Jun. 23, 1986

Related U.S. Application Data

[63] Continuation-in-part of Ser. No. 771,710, Sep. 3, 1985, abandoned.

[30] Foreign Application Priority Data

Jul. 20, 1985 [GB] United Kingdom ..... 8518366
Feb. 19, 1986 [GB] United Kingdom ..... 8604110

[51] Int. Cl.[4] ..... E21B 4/02
[52] U.S. Cl. ..... 175/93; 175/321
[58] Field of Search ..... 175/93, 296, 321

[56] References Cited

U.S. PATENT DOCUMENTS 2,313,806 3/1943 Crites ..... 175/93
2,635,852 4/1953 Snyder ..... 175/93
3,280,923 10/1966 Muench ..... 175/93

FOREIGN PATENT DOCUMENTS 735818 of 1943 Fed. Rep. of Germany ..... 175/93
806102 6/1956 United Kingdom ..... 175/93

*Primary Examiner*—Stephen J. Novosad
*Assistant Examiner*—William P. Neuder
*Attorney, Agent, or Firm*—W. Thad Adams, III

[57] ABSTRACT

A drilling apparatus has a rotatable drilling rod (15) on the leading end of which is mounted a bit assembly including a bit (10) and a bit driver (12) for reciprocating the bit. The bit driver is powered by a high pressure fluid supplied from a fluid pressurizing apparatus interposed between the rod and bit assembly and including a device (16,18/114) for raising the pressure of fluid in a closed circuit into which said bit driver is connected, the said device being driven from a power source remote from it, for example, on the surface of the ground in which a hole is being drilled.

13 Claims, 8 Drawing Figures

DRILLING APPARATUS

This application is a continuation-in-part of application Ser. No. 771,710, filed 9/3/85, now abandoned.

The present invention concerns improvements in or relating to hole forming apparatus, especially but not exclusively apparatus for drilling through soil or rock involving a technique known as "down the hole" drilling which may involve rotary percussive drilling or purely percussive drilling.

With a rotary percussive drilling technique the means for percussing the drilling bit of the downhole drill is located at the drill so that as the drill descends the means of percussion descends with it. Clearly if the drilling has to extend to any appreciable depth the drilling rod to which the drill is attached must be made in sections so that sections can be added as the depth of the hole increases. If the means for percussion within the drill is an hydraulic motor, as each section of rod is added, it is necessary to add also an extra length of hydraulic feed line and this operation is not only difficult and time consuming but also, in view of the conditions in which drilling operations are carried out, gives rise to the possibility of contaminating the hydraulic fluid. Similar problems will occur with a purely percussive operation when the hydraulic motor for the bit is located down the hole.

It is an object of the present invention to obviate or mitigate these disadvantages.

In the present specification the term "hole forming apparatus" is intended to mean any apparatus forming a hole or the like through soil or rock, for example a drill, a pile driving arrangement, an anchor bolt placing device.

According to the present invention there is provided hole forming apparatus comprising a bit assembly adapted to be driven by a pressurised fluid and fluid pressurising apparatus located adjacent the bit assembly and having a fluid connection therewith, the fluid pressurising apparatus including a device energised by means remote from it for increasing the pressure of fluid passing therethrough.

Preferably the bit assembly includes a bit driver and a bit, the bit driver and the fluid pressurising apparatus forming a closed circuit.

Preferably the said device of the fluid pressurising apparatus is a piston and cylinder device.

Preferably the fluid is hydraulic fluid but alternatively may be a gas.

Preferably an accumulator may be provided in the fluid connection between the pressurising device and the bit driver of the bit assembly.

Preferably the apparatus includes a heat exchanger for removing heat generated in the fluid pressurising apparatus. The heat exchanger may be positioned in or near a high and/or low pressure reservoir of fluid for the fluid pressurising apparatus.

Preferably the bit driver drives the bit percussively and/or rotary percussively.

Preferably a non-return valve is included in the line taking pressure fluid from the cylinder of the piston and cylinder device to the bit assembly and a similar non-return valve is included in a fluid return line, returning fluid exhausted from the bit assembly to the piston and cylinder device.

Preferably the fluid return line leads to that part of the cylinder in connection with the low pressure side of the piston and a passage is provided through the piston to allow leakage of fluid from said low pressure side to the high pressure side on the return stroke of the piston. Preferably a one-way pressure sensitive valve is incorporated in this passage.

Preferably the hole forming apparatus is adapted for down the hole drilling and the fluid pressurising apparatus is located adjacent to the bit driver of the bit assembly, extendable connection means being provided leading from the piston of the pressurising apparatus to the surface where means are provided for reciprocating said connection means. The connection means are preferably located in an outer or inner casing through which flushing fluid for the bit assembly is supplied to remove debris formed by the drill bit.

Preferably heat removed by the heat exchanger is transferred to the flushing fluid or any other medium passing through or surrounding or coming into contact with the heat exchanger.

In a modification the device of the fluid pressurising apparatus is a rotary pump. Means may be provided for transmitting rotation to said pump from a means remote from it, the means including a rotatable drive member which may be an inner or an outer casing of the assembly. A gear box may be connected between the device and the rotatable member.

An embodiment of the present invention will now be described by way of example only with reference to the accompanying drawings, in which.

Figure 1:
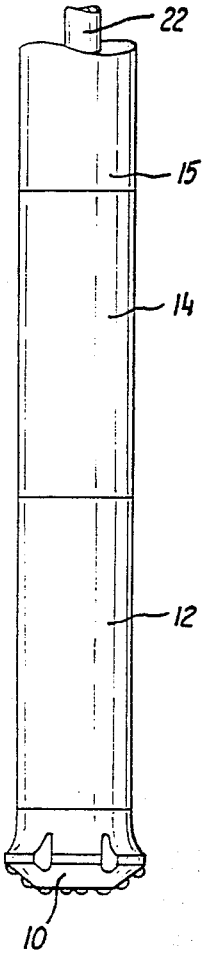
FIG. 1 shows an external view of a down the hole drilling assembly of a hole forming apparatus.

A down-the-hole drilling assembly of a hole forming apparatus comprises a bit assembly including a drill bit 10 of normal construction connected to a rotary percussive downhole drill 12. An hydraulic pressurising apparatus 14 is connected to the upper end of the downhole drill 12 and to an outer drilling casing 15 of the type normally employed in a rock drilling operation of this nature, that is a casing which is rotated by means located on the surface and which causes the drill bit 10 to rotate. The hydraulic pressurising apparatus comprises a cylinder 16 in which is mounted a piston 18, the piston being connected to the drilling mast 20 (FIG. 4) by means of sectional connecting rods 22 extending upwardly from the piston, the piston rod 19 passing through a gland 24 on the upper wall of the cylinder.

Figure 3:
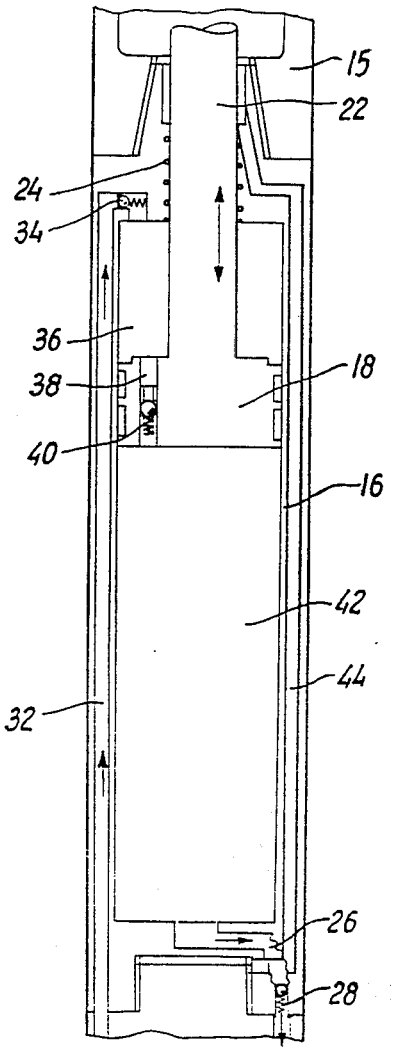
FIG. 3 shows a diagrammatic sectional view of the assembly to a larger scale.
Figure 4:
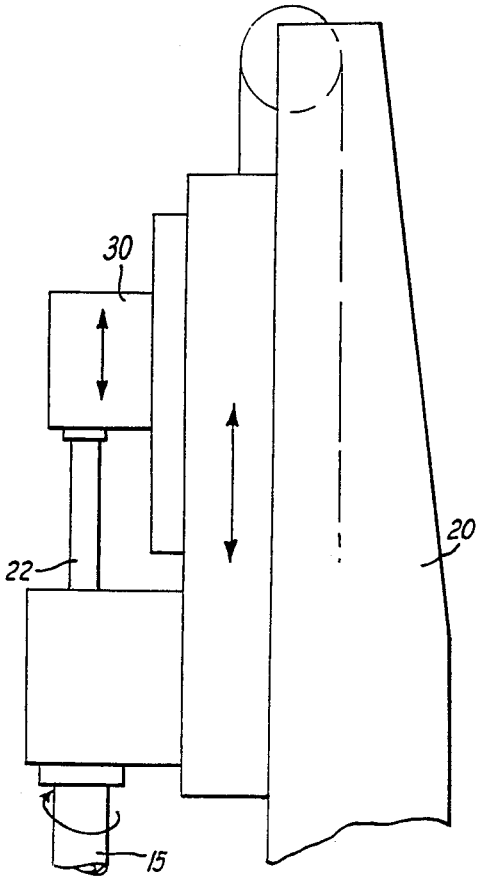
FIG. 4 shows a view of the mast head from which the hole forming apparatus is supported.

FIG. 3 shows the pressure assembly in greater detail and it can be seen that from the lower end of the cylinder 16 there extends a high pressure hydraulic line 26 which incorporates a one-way valve 28. It will be realised that a supply of hydraulic fluid at a predetermined pressure can be supplied to the downhole drill 12 by causing the piston 18 to descend in the cylinder 16. Descent of the piston may be caused by driving means 30 at the top of the connection rods 22 as shown in FIG. 4 but in certain instances the self-weight of the connection rods provides an adequate driving force. When the pressure fluid has been exhausted from the downhole drill 12 it is passed, by way of line 32, through a one-way valve 34 to the low pressure side 36 of the cylinder 16. When the driving means 30 at the rig head 20 are operated to lift the connecting rod and thereby retract the piston 18 in the cylinder 16 prior to a further pressurising downward stroke, fluid from the low pressure side 36 of the cylinder passes by way of a passage 38 through the piston (the passage being provided with a one-way valve 40) into the high pressure side 42 of the cylinder ready for a next pressurising operation.

Flushing fluid for use in the drilling operation can be supplied from the surface by way of the interior of the outer casing sections 15 and a flushing fluid conduit 44 in the wall of the cylinder 16.

It will be realised, therefore, that by raising and lowering the connecting rods 22, which can be easily extended, pressure fluid can be supplied to the downhole drill irrespective of the depth below ground of the downhole drill.

Various modifications can be made without departing from the scope of the invention, for example an hydraulic accumulator can be interposed in the line 26. In a further modification a gas rather than a liquid can be utilised in the pressure means. The hydraulic connections, valves etc. can be arranged in any convenient manner. Flushing fluid for the drilling operation may be supplied by way of an inner casing, rather than the outer casing 15 as illustrated in the drawings.

In a further modification the piston and cylinder device of the hydraulic pressurising apparatus is replaced by any other suitable means capable of being energised from a remote source, e.g. at the drilling mast, and producing pressurised fluid. Examples of such means are rotary pumps (axial or centrifugal), gear pumps, solenoid operated pumps, etc.

Figure 2:
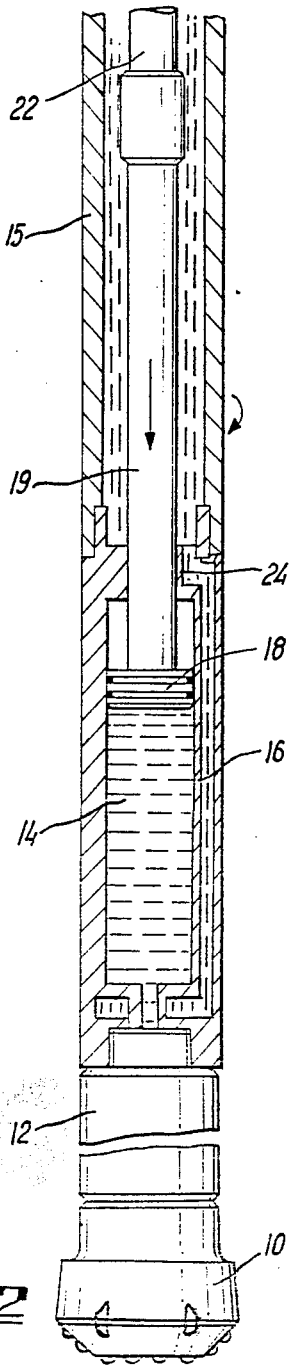
FIG. 2 shows a sectional view of the assembly shown in FIG. 1.
Figure 5:
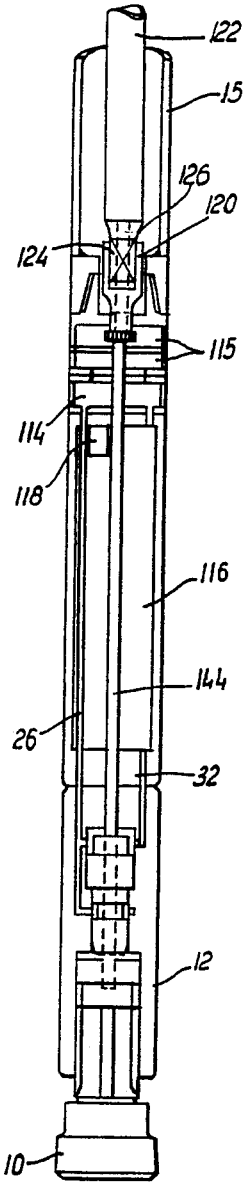
FIG. 5 shows a view similar to FIG. 2 of a first modified assembly.

FIG. 5 shows a first modified assembly in which components which are similar to those of the FIGS. 1 to 3 embodiment have been given the same reference numerals. In this modification the reciprocating pressure assembly has been replaced by a rotary assembly including a rotary pump 114 and a gear box 115. The pressure assembly includes a reservoir 116 for low pressure fluid in which may be accommodated an accumulator 118 interposed in the high pressure line 26 between pump 114 and the cylinder of the hammer 12. Drive is transmitted to the gear box 115 by a coupling 120 having a square, hexagonal or any other cross-section socket 124 that ensures no slippage, adapted to receive unrotatably the end 126 of the hollow connecting rod 122 through which flushing fluid may be supplied, the flushing fluid being conveyed to the drill bit 10 by a conduit 144 which passes through the gear box, pump, reservoir and hammer.

Figure 6:
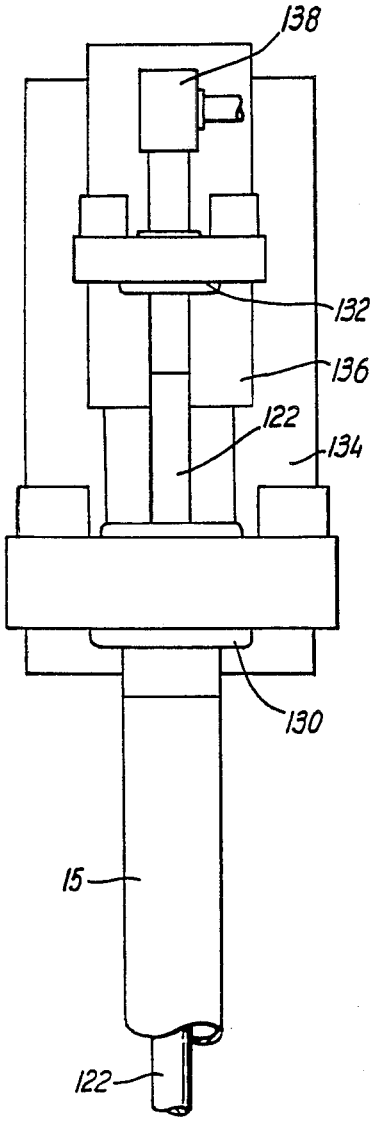
FIG. 6 shows a view similar to FIG. 2 of a second modified assembly.

FIG. 6 shows a modified mast head for use with the modification shown in FIG. 5. The head has a first rotary motor 130 for driving the outer casing 15 and a second rotary motor 132 for driving the string of connecting rods 122. the first motor 130 is mounted on a primary slide 134 vertically movable on the mast (not shown) and the second motor 132 is mounted on a secondary slide 136 slidably mounted on the primary slide 134. A gland 138 is provided at the upper end of the string of connecting rods 122 to supply flushing fluid thereto.

Figure 7:
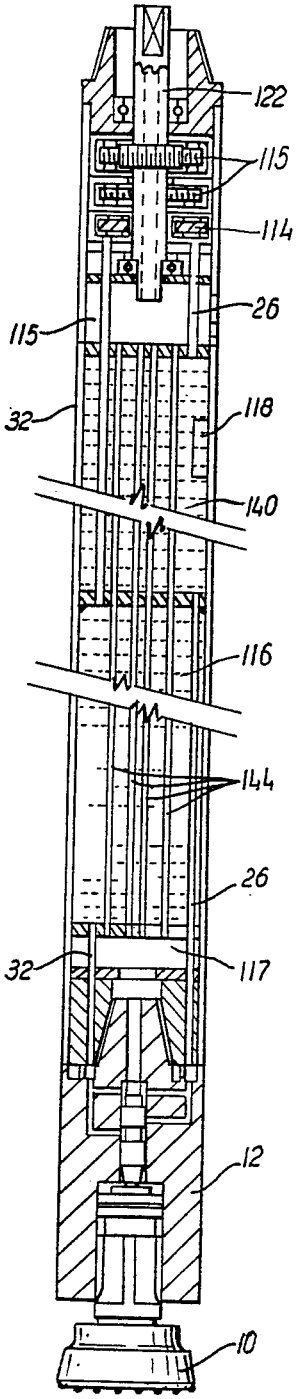
FIG. 7 shows a front view of a modified mast head for use with the modifications of FIGS. 5 and 6.

FIG. 7 shows a further modified assembly incorporating heat exchanger means for removing heat generated by the rotary pump 114. This modification includes also a high pressure reservoir 140 in which the accumulator 118 is accommodated. The heat exchanger means comprise a plurality of tubes 144 which could have internal or external fins for flushing fluid which lead from an upper chamber 115 to a lower chamber 117, passing through the high and low pressure reservoirs 140, 116 and taking in heat therefrom. The upper chamber receives flushing fluid from the hollow connecting rods 122 and the lower chamber 117 exhausts flushing fluid to the hammer unit 12.

In a modification of the assembly shown in FIG. 6 the heat exchanger means 144 may run over the exterior of the fluid reservoirs and indeed heat from the fluid may be given up to any other medium passing through or surrounding or coming into contact with the heated fluid of the pressure assembly.

Figure 8:
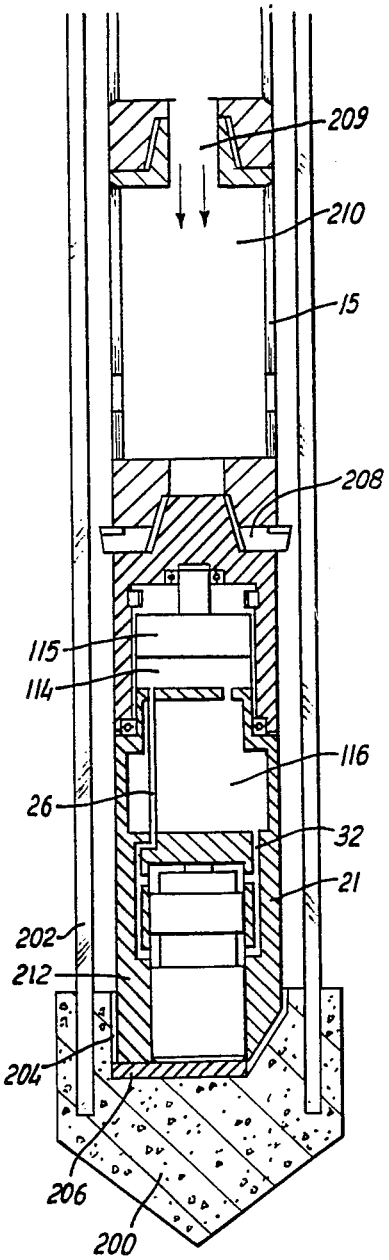
FIG. 8 shows a view similar to FIG. 2 of an apparatus for placing anchor wires.

In the embodiment and modifications described above a rotary percussive drilling assembly is described. In a further modification the assembly is a purely percussive bit assembly which may form holes purely by the reciprocation of the bit. The assembly may drive down into the ground a hollow pile casing or the base plate of an anchor bolt from which anchor cables extend upwardly to the surface and to which structures to be fixed can be attached. Such a modification is illustrated in FIG. 8. In this modification the hammer 212 is held against rotation by the ground engaging base plate 200 of the anchor bolt from which the anchor cable 202 extends. The plate is ribbed on its exterior surface to resist rotation and has a recess 204 for the hammer which accommodates the hammer but prevents relative rotation therewith. A striker plate 206 may be positioned at the base of the recess to absorb impact loads.

In the modification no rotary connecting rods are required as the hammer does not rotate. The rotation of the outer casings 15 is transmitted to the gear box 115 which drives the pump 114 supplying pressure fluid for operating the reciprocating hammer.

A back reaming cutter 208 may be provided on the lower outer casing 15 to assist in removal of the assembly after the plate 200 has been driven into position and grout passage and control means 209, 210 may be provided in the casing 15 to discharge grout into the hole left above the plate on removal of the assembly.

We claim:

1. A hole forming apparatus, comprising:

(a) a bit assembly adapted to be driven from the surface in a plurality of modes, including by a pressurized fluid;

(b) a fluid pressurizing apparatus located adjacent the bit assembly and having a fluid connection therewith for supplying pressurized fluid for driving the bit assembly in the said one mode, the fluid pressurizing means and the bit assembly forming a closed hydraulic circuit operable without fluid being pumped from the surface;

(c) first drive means mechanically driving the fluid pressurizing means; and (d) second drive means operable to drive the bit assembly in a second mode independent of the first drive means, said first drive means being controllable at the surface independently of said second drive means.

2. Apparatus as claimed in claim 1, in which the bit assembly includes a bit driver and a bit, the bit driver and the fluid pressurizing apparatus forming a closed hydraulic circuit.

3. Apparatus as claimed in claim 1 or 2, in which the said device of the fluid pressurizing apparatus is a piston and cylinder device.

4. Apparatus as claimed in claim 1 or claim 2, in which the said device of the fluid pressurizing apparatus is a rotary pump.

5. Apparatus as claimed in claim 2, in which an accumulator is provided in the fluid connection between the fluid pressurizing apparatus and the bit driver of the bit assembly.

6. Apparatus as claimed in claim 1, including a heat exchanger positioned in or near a high and/or low pressure reservoir of fluid for the fluid pressurizing apparatus for removing heat generated in the fluid pressurizing apparatus.

7. Apparatus as claimed in claim 3, in which a non-return valve is included in the line taking pressure fluid from the cylinder of the piston and cylinder device to the bit assembly and a similar non-return valve is included in a fluid return line, returning fluid exhausted from the bit assembly to the piston and cylinder device.

8. Apparatus as claimed in claim 7, in which the fluid return line leads to that part of the cylinder in connection with the low pressure side of the piston and a passage is provided through the piston to allow leakage of fluid from said low pressure side to the high pressure side on the return stroke of the piston.

9. Apparatus as claimed in claim 8, in which a one-way pressure sensitive valve is incorporated in the passage through the piston.

10. Apparatus as claimed in claim 3, adapted for down the hole drilling with the fluid pressurizing apparatus located adjacent to the bit driver of the bit assembly, extendable connection means being provided leading from the piston of the pressurizing apparatus to the surface where means are provided for reciprocating said connection means.

11. Apparatus as claimed in claim 10, in which the connection means are located in an outer or inner casing through which flushing fluid for the bit assembly is supplied.

12. Apparatus as claimed in claim 6, in which heat removed by the heat exchanger is transferred to flushing fluid or any other medium passing through or surrounding or coming into contact with the heat exchanger.

13. Apparatus as claimed in claim 4, in which means are provided for transmitting rotation to said pump from a means remote from it, the means including a rotatable drive member which may be an inner or an outer casing of the assembly.

* * * * *